United States Patent [19]

Shaffer et al.

[11] 4,270,885

[45] Jun. 2, 1981

[54] UNLOADING MEANS FOR A GAS COMPRESSOR

[75] Inventors: Robert W. Shaffer; Henry W. Morse, both of Campbellsville, Ky.

[73] Assignee: Ingersoll-Rand Company, Woodcliff Lake, N.J.

[21] Appl. No.: 36,349

[22] Filed: May 7, 1979

[51] Int. Cl.[3] ..... F04B 49/00

[52] U.S. Cl. ..... 417/279; 417/295; 417/299; 417/307; 417/308; 417/310

[58] Field of Search ..... 417/279, 295, 308, 307, 417/299, 281, 291, 310

[56] References Cited

U.S. PATENT DOCUMENTS

| | | | |
|---|---|---|---|
| 1,352,751 | 9/1920 | Jackson | 417/279 |
| 2,235,251 | 3/1941 | Boldt | 417/295 |
| 2,722,395 | 11/1955 | Boyce | 417/295 |
| 3,406,897 | 10/1968 | Diels | 417/295 |
| 3,447,496 | 6/1969 | Short | 417/295 |
| 3,759,636 | 9/1973 | Schaefer et al. | 417/299 |

*Primary Examiner*—William L. Freeh
*Assistant Examiner*—Rae Cronmiller
*Attorney, Agent, or Firm*—Bernard J. Murphy

[57] ABSTRACT

In the embodiment shown, the invention comprises a suction/check valve interposed in a gas inlet channel, the channel being open at one end for communication with the atmosphere, and at the opposite end for communication with a gas compressor inlet port. The valve has a bleed hole formed therein for slowly blowing down the compressor receiver at shutdown. A second check valve is operatively interposed between the receiver and the atmosphere for depressurizing the receiver when the compressor unloads. A conduit which communicates with both valves provides a valve-operating, fluid, pilot-pressure to close off the suction/-check valve, and to interdict its bleed hole, and to open the second check valve, with compressor unloading.

15 Claims, 2 Drawing Figures

UNLOADING MEANS FOR A GAS COMPRESSOR

This invention pertains to mechanisms for unloading gas compressors.

Unloading for gas compressors is usually accomplished, in a typical manner, as follows. When the maximum desired discharge pressure is reached, the suction or inlet port of the compressor is throttled with some valving means, thus drawing a vacuum in the suction or inlet chamber and reducing the capacity to zero. At the same time, the receiver, or oil/air separator in oil-flooded compressors, which is at discharge pressure, is bled down to atmospheric pressure. This method of unloading reduces the power into the compressor to about twenty percent of the rated compressor power. Often, timers are included which shut down the compressor if the unit runs unloaded for some period of time without reloading.

It is an object of this invention to set forth an improved, simplified, and compact mechanism for throttling the suction of a compressor and for dumping the pressure in the receiver or oil/air separator thereof.

Particularly, it is an object of this invention to disclose unloading means, for a gas compressor having a compressed gas receiver, comprising means defining a gas-conducting channel; said channel having one end thereof open for communication with the atmosphere, and an opposite end open for communication thereof with a gas compressor inlet port; and valving means, interposed in said channel, and movable between first and second positions within said channel, having means which opens said channel to gas conduct therethrough when in said second position, and which substantially closes said channel to gas conduct when in said first position; wherein said valving means comprises means which, when said valving means is in said first position, provides for a minute, bleed-type, fluid-flow communication between said one and opposite ends of said channel.

Figure 1:
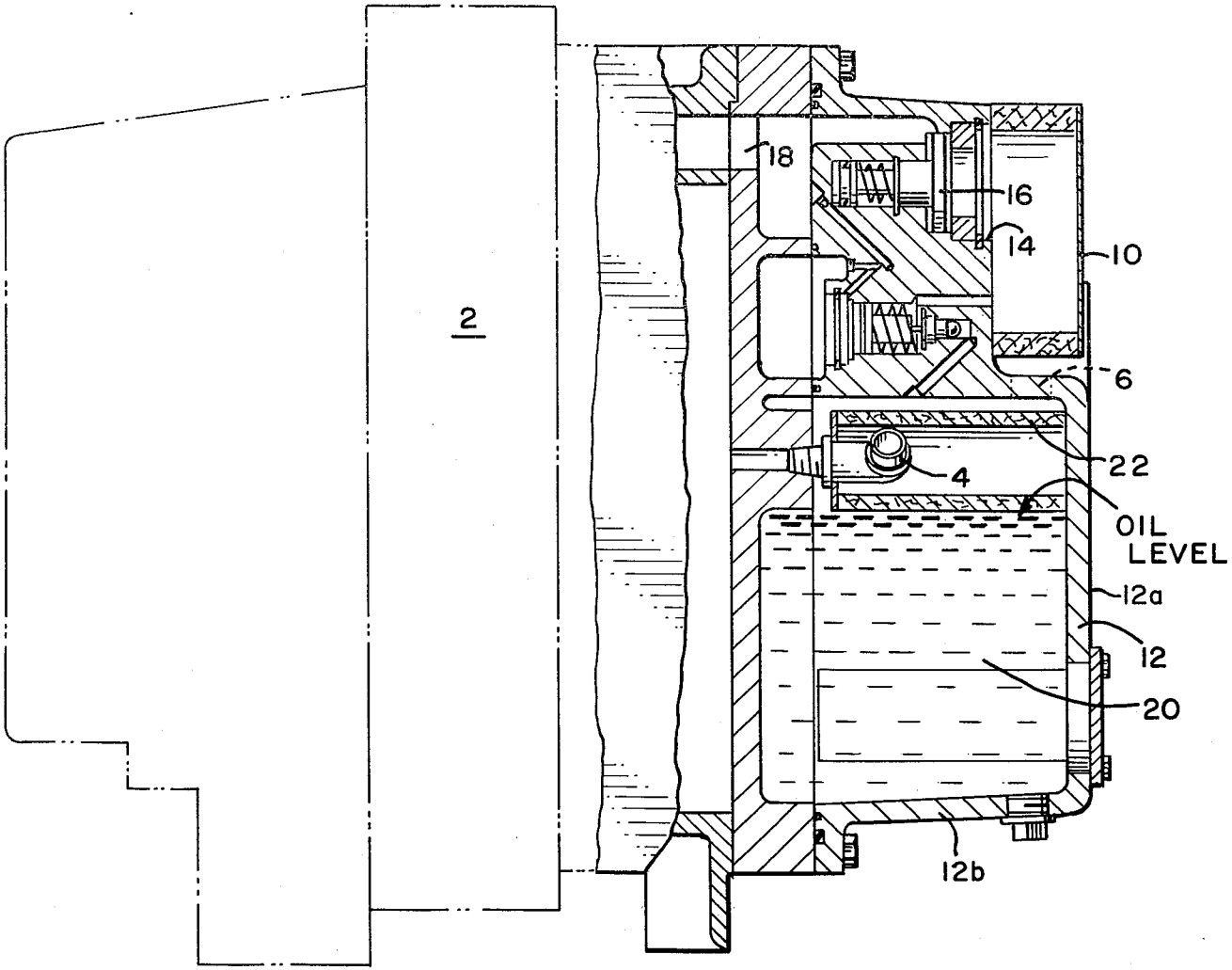
Figure 2:
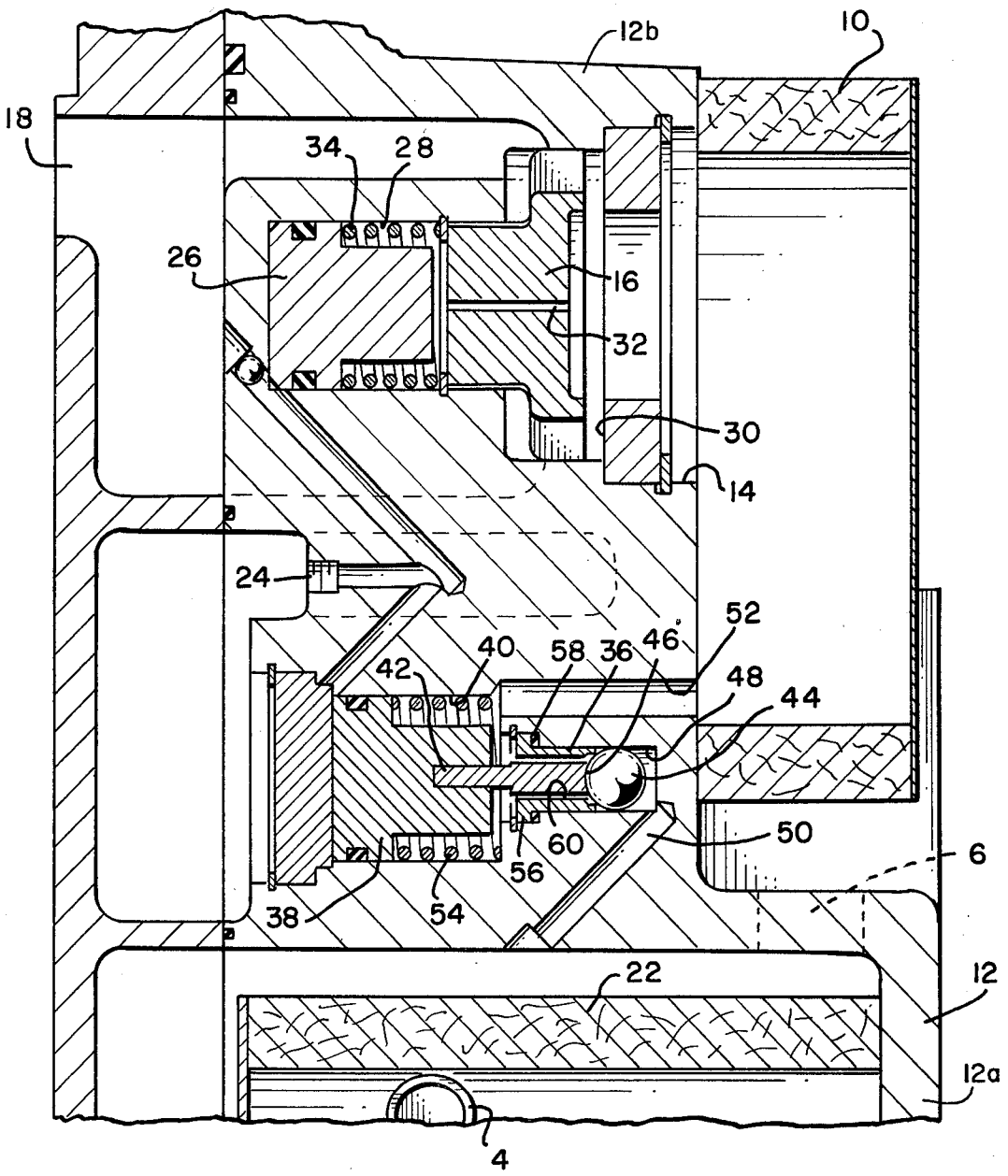

Further objects of this invention, as well as the novel features thereof, will become more apparent by reference to the following description taken in conjunction with the accompanying firgures, in which:

FIG. 1 is a partial outline, and partial cross-sectional drawing, of a rotary, gas compressor, of the oil-flooded type, the same showing an end housing/oil-air separator thereof in cross-section, and the compressor per se only in outline; and FIG. 2 is a cross-sectional view of an embodiment of the novel unloading means taken vertically through the end housing/oil-air separator (of FIG. 1) in which the unloading means is compactly enclosed. (Said means are not shown in FIG. 1.)

As shown in the figures, air is drawn into the compressor 2 through a suction filter 10 which is mounted onto the end housing/oil-air separator 12 over an inlet aperture 14. The filtered air then passes through a suction valve 16 which is interposed in the aperture, and enters the compressor via an inlet port 18. The suction valve 16 will be discussed in detail latter. The end housing/oil-air separator 12 comprises a first, substantially vertical wall 12*a* and a second wall 12*b* substantially normal to the first wall. The second wall 12*b* defines an opening, and has a mounting flange thereabout, for mounting of the separator 12 to a gas compressor, and to define an enclosure therewithin.

As the air enters the compressor 2, an oil-flooded, rotary compressor, for example, it is mixed with oil from an oil cooler (not shown). The oil and air mixture is then compressed and discharged, via pipe 4, into an oil/air separator 20 portion of housing/separator 12. The oil and air mixture is then separated in the separator; large droplets of oil return to the bottom of the oil reservoir defined by the separator 20, and the fine oil mist is coalesced in a coalescing type demister 22. Oil-free air is then discharged from the compressor via an outlet pipe 6.

Thus far, the arrangement is quite conventional. The new teaching and improvement resides in the unique valving means provided for unloading.

The suction valve 16 has several functions and unique features. In FIG. 2, it is shown in the open position, thus allowing the free flow of air into the compressor 2. When the compressor reaches its maximum discharge pressure, an auxillary valve (not shown) which is mounted downstream of outlet pipe 6, actuates and bleeds air at discharge pressure into passage 24 formed in end housing 12. The passage connects with the back side of a piston 26 slidably restrained in a cylinder 28, so that the control or "pilot" pressure from the auxillary valve forces the piston forward against the suction valve 16. In turn, the valve 16 moves forward against the valve seat 30. This action seals off the compressor inlet and causes the compressor to draw a vacuum. Note that the piston 26 seals a bleed hole 32 formed in valve 16, when it is forwarded in the "unloaded" position. The function of the bleed hole 32 will be discussed later. When the air receiver pressure drops to a predetermined minimum value, the auxillary valve dumps the control pressure to the atmosphere and a return spring 34 returns the piston 26, and the suction valve 16 opens loading the compressor.

The suction valve 16 also acts as a check valve. It has a stem portion which is freely, slidably received in the cylinder 28. Accordingly, upon start-up of the compressor 2, a vacuum or negative pressure is created at the inlet port 18 and is present on the rear surface of the enlarged portion of valve 16. Hence, with atmospheric pressure on the opposite, front surface of the valve 16, the valve withdraws from the valve seat 30, to open the aperture 14 to the port 18. Similarly, when the compressor 2 is stopped under load, the greater back pressure at port 18, vis-a-vis the atmospheric pressure at aperture 14, causes the valve 16 to close the aperture 14. This is necessary for stopping the compressor under load. If the suction valve did not close during a loaded stop, the pressurized air in the separator 20 would flow back through the compressor, the same, as noted, being a rotary compressor, causng the compressor to run backward until the pressure reached atmospheric. In the process, large quantities of oil would blow out the inlet aperture 14 with the air. The check valving feature of the suction valve 16 prevents the rapid blow-down of the separator 20, and thus prevents the compressor from "motoring" backward and spewing oil. The bleed hole or passage 32 allows the separator to slowly return to atmospheric pressure (which is necessary to prevent an unsafe condition). When the compressor stops under load, the piston 26 is not actuated so that the bleed passage 32 is open. Bleeding-down of the separator is effected through the slidable clearance between the valve 16 and wall of the cylinder 28, and therefrom through the passage 32. As priorly noted, the stem portion of valve 16 is freely, slidably received in the cylinder 28. Between the stem portion and the wall of the cylinder 28 is defined a bleed-type or capillary, fluid-flow accommodating space. Thus, when the compressor is operating, the gas inlet flow path or gas-conducting channel is defined by the stepped, inlet aperture 14, principally. A minor portion of the gas-conducting channel, of course, comprises the bleed hole 32 and the aforesaid capillary, fluid-flow-accommodating space. Then, when the compressor is stopped under load, the gas-conducting channel, for the bleeding-down of the compressor, is the same capillary, fluid-flow accommodating space, the bleed hole 32, and the stepped, inlet aperture 14—these same structures or pathways, again, with flow in the opposite direction, however. With the compressor 2 running, and ingesting gas, most of the gas flow proceeds directly from the aperture 14 (of the priorly-defined gas-conducting channel) to the port 18, and bypasses the bleed hole 32. When the compressor 2 is stopped under load, however, the bleed hole 32 is the only functioning portion of the gas-conducting channel; all bleeding-down gas flow passes therethrough. The gas-conducting channel, then, comprises all the fluid-flow pathways between the outermost portion of aperture 14 and the entry of port 18, comprising the stepped, walled surface inboard of the aperture 14, the space between the stem of the valve 16 and the wall cylinder 28, and the bleed hole 32 formed in valve 16.

When the compressor unloads, it is also desirable to dump the pressure in the oil-air separator 20. This is accomplished with a second, dump valve 36. When the auxillary valve actuates, pressurizing passage 24, a second piston 38, slidably restrained in a second cylinder 40 formed in the end housing 12 is also actuated. Piston 38 translates a plunger 42 with which it is engaged to lift a ball 44 off a seat 46 provided therefor in a chamber 48. This allows clean oil-free air from the downstream side of the demister 22 to bleed through a chamber-communicating passage 50 around a metering orifice formed by the ball 44 and into the suction filter 10 via a passage 52. When the auxillary valve loads the compressor, bleeding the control pressure to atmosphere, a return spring 54 returns piston 38 which allows the ball 44 to seat and prevent any further air loss from the separator. 20. Ball 44 has a diameter smaller than that of chamber 48; hence it is between the o.d. of the ball 44 and the i.d. of the chamber 48 that the metering orifice is defined. The valve seat 46 is formed on an end of a chamber wall-engaging sleeve 56 which thereabout receives a seal 58 to fluid-seal the interface of the sleeve 56 with the wall of chamber 48. The plunger or actuator 42, however, has loose sliding fit with the passage 60 of the sleeve. Accordingly, the aforesaid metering orifice freely vents through the sleeve 56—along the plunger or actuator 42—upon the ball 44, being displaced from the seat 46.

While we have described our invention in connection with a specific embodiment thereof, it is to be clearly understood that this is done only by way of example, and not as a limitation to the scope of our invention as set forth in the objects thereof and in the appended claims.

We claim:

1. Unloading means, for a gas compressor having a compressed gas receiver, comprising:

means defining a gas-conducting channel;

said channel having one end thereof open for communication with the atmosphere, and an opposite end open for communication thereof with a gas compressor inlet port; and valving means, interposed in said channel, and movable between first and second positions within said channel, having means which opens said channel to gas conduct therethrough when in said second position, and which substantially closes said channel to gas conduct when in said first position; wherein said valving means comprises means which, when said valving means is in said first position, provides for a minute, bleed-type, fluid-flow communication between said one and opposite ends of said channel.

2. Unloading means, for a gas compressor, according to claim 1, wherein:

said communication providing means comprises an orifice formed in said valving means; and further including means operative for closing said orifice to interdict fluid flow therethrough and, thereby, to close fluid flow communication between said one and opposite ends of said channel.

3. Unloading means, for a gas compressor, according to claim 2, wherein:

said orifice-closing means comprises means for moving said valving means from one of said first and second positions to the other thereof.

4. Unloading means, for a gas compressor, according to claim 3, wherein:

said orifice-closing means includes an element translatable in a first direction, in response to a fluid, pilot-pressure addressed thereto, to move said valving means to said first position.

5. Unloading means, for a gas compressor, according to claim 4, further including:

means normally biasing said element in a second translatable direction which is opposite said first direction.

6. Unloading means, for a gas compressor, according to claim 4, further including:

means for addressing a fluid, pilot-pressure to said element.

7. Unloading means, for a gas compressor, according to claim 1, further including:

conduit means having one end thereof open for communication with the atmosphere, and an opposite end open for communication thereof with a compressed gas receiver; and second valving means, interposed in said conduit, and movable between first and second dispositions within said conduit, having means which closes said conduit to gas flow therethrough when in a given one of said first and second dispositions, and which opens said conduit to gas flow when in the other of said first and second dispositions.

8. Unloading means, for a gas compressor, according to claim 7, wherein:

said second valving means comprises means defining a metering orifice which is open to fluid conduct therethrough, upon said second valving means being in said other disposition.

9. Unloading means, for a gas compressor, according to claim 1, further including:

an end housing for a gas compressor;

said end housing having a first substantially vertical wall, and a second wall substantially normal to said vertical wall;

said end housing being open at a side thereof which is opposite said vertical wall; and said second wall having mounting surfacing formed thereon for mounting of said end housing to a gas compressor, to define an enclosure therewithin; wherein said one end of said channel is formed in said vertical wall of said end housing.

10. Unloading means, for a gas compressor, according to claim 9, wherein:

said one end of said channel comprises a port formed in said vertical wall.

11. Unloading means, for a gas compressor, having a compressed gas receiver, comprising:

means defining a gas-conducting channel;

said channel having one end thereof open for communication with the atmosphere, and an opposite end open for communication thereof with a gas compressor inlet port; and valving means, interposed in said channel, and movable between first and second positions within said channel, having means which opens said channel to gas conduct therethrough when in said second position, and which substantially closes said channel to gas conduct when in said first position; wherein said valving means comprises means which, when said valving means is in said first position, provides for a minute, bleed-type, fluid-flow communication between said one and opposite ends of said channel; further including an end housing for a gas compressor;

said end housing having a first substantially vertical wall, and a second wall substantially normal to said vertical wall;

said end housing being open at a side thereof which is opposite said vertical wall; and said second wall having mounting surfacing formed thereon for mounting of said end housing to a gas compressor, to define an enclosure therewithin; wherein said one end of said channel is formed in said vertical wall of said end housing;

said one end of said channel comprises a port formed in said vertical wall; and further including a gas filter fixed to an outermost surface of said vertical wall, and overlying said port;

conduit means having one end thereof open for communication with the atmosphere, and an opposite end open for communication thereof with a compressed gas receiver; and second valving means, interposed in said conduit, and movable between first and second dispositions within said conduit, having means which closes said conduit to gas flow therethrough when in a given of said first and second dispositions, and which opens said conduit to gas flow when in the other of said first and second dispositions; and wherein said one end of said conduit means opens through said vertical wall onto said outermost surface thereof.

12. Unloading means, for a gas compressor having a compressed gas receiver, comprising:

means defining a gas-conducting channel;

said channel having one end thereof open for communication with the atmosphere, and an opposite end open for communication thereof with a gas compressor inlet port; and valving means, interposed in said channel, and movable between first and second positions with said channel, having means which opens said channel to gas conduct therethrough when in said second position, and which substantially closes said channel to gas conduct when in said first position; wherein said valving means comprises means which, when said valving means is in said first position, provides for a minute, bleed-type, fluid-flow communication between said one and opposite ends of said channel; further including conduit means having one end thereof open for communication with the atmosphere, and an opposite end open for communication thereof with a compressed gas receiver; and second valving means, interposed in said conduit, and movable between first and second dispositions within said conduit, having means which closes said conduit to gas flow therethrough when in a given one of said first and second dispositions, and which opens said conduit to gas flow when in the other of said first and second dispositions; and wherein said second valving means comprises means defining a metering orifice which is open to fluid conduct therethrough, upon said second valving, means being in said other disposition; and said orifice-defining means comprises a cylindrical bore having a given diameter and a ball having a diameter of less than said given diameter slidably disposed in said bore.

13. Unloading means, for a gas compressor, according to claim 12, wherein:

said second valving means further comprises a valve seat, within said cylindrical bore, which receives said ball thereon to close said metering orifice to gas flow, and means operative for displacing said ball from said valve seat to open said metering orifice to gas flow.

14. Unloading means, for a gas compressor, according to claim 13, wherein:

said ball-displacing means comprises an actuator translatable in a given direction, in response to a fluid, pilot-pressure addressed thereto, to displace said ball from said valve seat.

15. Unloading means, for a gas compressor, according to claim 14, further including:

means normally biasing said actuator in an other translatable direction which is opposite said given direction; and means for addressing a fluid, pilot-pressure to said actuator.

* * * * *